US008721027B2

(12) United States Patent
Otsuka et al.

(10) Patent No.: US 8,721,027 B2
(45) Date of Patent: May 13, 2014

(54) DISCHARGE AMOUNT CALCULATING DEVICE AND FLUID EJECTING APPARATUS

(75) Inventors: Shuji Otsuka, Shiojiri (JP); Fumitaka Sugimoto, Kota-cho (JP)

(73) Assignee: Seiko Epson Corporation, Tokyo (JP)

( * ) Notice: Subject to any disclaimer, the term of this patent is extended or adjusted under 35 U.S.C. 154(b) by 108 days.

(21) Appl. No.: 13/246,742

(22) Filed: Sep. 27, 2011

(65) Prior Publication Data

US 2012/0019574 A1 Jan. 26, 2012

Related U.S. Application Data

(63) Continuation of application No. 12/548,386, filed on Aug. 26, 2009, now Pat. No. 8,047,624.

(30) Foreign Application Priority Data

Aug. 27, 2008 (JP) ..... 2008-217654

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 6,517,175 | B2 | 2/2003 | Kanaya et al. | |
| 2007/0040877 | A1 | 2/2007 | Kachi | |
| 2007/0216725 | A1 * | 9/2007 | Hosono | 347/47 |

FOREIGN PATENT DOCUMENTS

| | | | |
|---|---|---|---|
| JP | 11-334107 | A | 12/1999 |
| JP | 2002-316428 | A | 10/2002 |
| JP | 2005-111707 | A | 4/2005 |

OTHER PUBLICATIONS

Translation of JP 11-334107 A. JP 11-334107 A was published on Dec. 7, 1999.*
Translation of JP 2002-316428 A. JP 2002-316428 A was published on Oct. 29, 2002.*

* cited by examiner

*Primary Examiner* — Justin Seo
(74) *Attorney, Agent, or Firm* — Kilpatrick Townsend & Stockton LLP

(57) ABSTRACT

A discharge amount calculating device for calculating the discharge amount of a fluid from a fluid ejecting apparatus is disclosed, in which the fluid ejecting apparatus is capable of ejecting at least one fluid onto a target at a discharge amount of multiple stages. The discharge amount calculating device includes a plurality of calculating sections that calculate the discharge amount of the fluid at the respective multiple stages based on a bit number of input data, a desired number of calculating sections not exceeding $2^n$ being provided, in which n is a positive integer, and a converting section that converts the inputted discharge amount data of n bits into bit number data corresponding to any one of the plurality of calculating sections, and outputs the converted data to the plurality of calculating sections.

2 Claims, 5 Drawing Sheets

FIG. 3

| CONNECTION DESTINATION | MODE A | MODE B |
|---|---|---|
| | EN–1 = '1' | |
| O3 | A1–1 | EN–1 |
| O2 | A0–1 | EN–0 |
| | EN–0 = '1' | |
| O1 | A1–0 | A1–0 & A1–1 |
| O0 | A0–0 | A0–0 & A0–1 |

FIG. 4

MODE A : COUNT OF 2 COLORS AND COLOR DEPTH 0 TO 3
[INPUT]
IF COLOR DEPTH 3 = 2'B11
COLOR DEPTH 2 = 2'B10
COLOR DEPTH 1 = 2'B01
COLOR DEPTH 0 = 2'B00,

I11 1111 1111 0000 0000
I10 1111 0000 1111 0000
I01 1100 1100 1100 1100
I00 1010 1010 1010 1010

[OUTPUT]
I11 = O3
I10 = O2
I01 = O1
I00 = O0

O3 1111 1111 0000 0000
O2 1111 0000 1111 0000
O1 1100 1100 1100 1100
O0 1010 1010 1010 1010

FIG. 5

MODE B : COUNT OF 1 COLOR AND COLOR DEPTH 0 TO 7
[INPUT]
IF COLOR DEPTH 7 = 3'B111
COLOR DEPTH 6 = 3'B110
COLOR DEPTH 5 = 3'B101
COLOR DEPTH 4 = 3'B100
COLOR DEPTH 3 = 3'B011
COLOR DEPTH 2 = 3'B010
COLOR DEPTH 1 = 3'B001
COLOR DEPTH 0 = 3'B000,

I11 1111 1111 0000 0000
I10 1111 0000 1111 0000
I01 1100 1100 1100 1100
I00 1010 1010 1010 1010

[OUTPUT]
I11 = DISREGARD
IF I10 = 1, '1' IS OUTPUTTED TO LINE O3,
AND IF I10 = 0, '1' IS OUTPUTTED TO LINE O2
I01 = O1
I00 = O0

O3 1111 0000 1111 0000
O2 0000 1111 0000 1111
O1 1100 1100 1100 1100
O0 1010 1010 1010 1010

DISCHARGE AMOUNT CALCULATING DEVICE AND FLUID EJECTING APPARATUS

This application is a continuation of U.S. application Ser. No. 12/548,386, filed Aug. 26, 2009, which claims priority to Japanese Patent Application No. 2008-217654, filed Aug. 27, 2008. The entireties of both applications are incorporated by reference herein.

BACKGROUND

1. Technical Field

The present invention relates to a discharge amount calculating device and a fluid ejecting apparatus.

2. Related Art

A fluid ejecting apparatus has been proposed to obtain the total amounts (i.e., an amount of consumption) of the respective colors of ink ejected from nozzles by adding the driving time (the number of ink droplets) of the driving mechanism provided in a print head and a driving power value (i.e., the size of ink droplet). One example of the fluid ejecting apparatus is disclosed in JP-A-2005-111707. The system mentioned in the publication JP-A-2005-111707 can obtain the remaining amount of ink by deducting the obtained ink consumption from the ink storage amount stored in an ink cartridge.

It is necessary for the discharge amount calculating device disclosed in the publication JP-A-2005-111707 to design and manufacture a discharge amount calculating device for obtaining a discharge amount of ink suitable for the apparatus, for example, when the apparatus is modified or altered to have a new configuration. However, a discharge amount calculating device is required which can more properly cope with configurations with an discharge amount of ink to be ejected at multiple stages or ink of various kinds, since the design and manufacture of the discharge amount calculating device needs labor power.

SUMMARY

An advantage of some aspects of the invention is that it provides a discharge amount calculating device and a fluid ejecting apparatus, in which the discharge amount calculating device can more properly cope with a construction in which a discharge amount of a fluid is varied at multiple stages and fluids of various kinds are ejected.

In order to achieve the above object, the invention employs the following means.

An aspect of the invention is to provide a discharge amount calculating device for calculating the discharge amount of a fluid from a fluid ejecting apparatus, the fluid ejecting apparatus being capable of ejecting at least one fluid onto a target at a discharge amount of multiple stages, the device comprising: a plurality of calculating sections that calculate the discharge amount of the fluid at the respective multiple stages based on a bit number of input data, a desired number of calculating sections not exceeding $2^n$ being provided, in which n is a positive integer; and a converting section that converts the inputted discharge amount data of n bits into bit number data corresponding to any one of the plurality of calculating sections, and outputs the converted data to the plurality of calculating sections.

The discharge amount calculating device converts inputted discharge amount data of n bits (n is a positive integer) into bit number data corresponding to any one of the plurality of calculating section by means of the converting section, outputs the converted data to the calculating section, and calculates the discharge amount of the fluid at the multiple stages, respectively, based on the inputted data of bit number by the use of the calculating sections which are provided by a desired number which does not exceed $2^n$. As such, since the data is converted by means of the converting section corresponding to the calculating section, for example, in the case multiple stages of the discharge amount are changed or the number of the fluids is changed, it can easily cope with the change by changing the converting manner of the converting section. Accordingly, it can more properly cope with a configuration in which the discharge amount of a fluid is varied at multiple stages and fluids of various kinds are ejected.

Preferably, the discharge amount calculating device according to the first aspect of the invention further comprises a calculate switching section that is connected between the calculating section and the converting section to perform switching between a first mode to calculate the discharge amount as the number of the first fluids and the number of first stages, and a second mode to calculate the discharge amount as the number of second fluids less than the number of the first fluids and the number of the second stages greater than the number of the first stages, in accordance with a desired selection signal. As such, the invention can more properly cope with various configurations by switching the mode, in which any number of the stages of the discharge amount and any number of the ink are selected.

It is preferable that the plurality of calculating sections are divided into a first calculating unit and a second calculating unit, and the discharge amount calculating device according to the invention further comprises a unit switching section that performs switching between a simultaneous mode to calculate simultaneously the discharge amount of the fluids by the first calculating unit and the second calculating unit, and a selection mode to calculate the discharge amount of the fluids by either the first calculating unit or the second calculating unit, in accordance with a desired selection signal. As such, the invention can more properly cope with various configurations by switching the counter every unit. In this instance, it is preferable that the unit switching section includes an enable switching portion for outputting the data inputted from the converting section as an enable signal to calculate the discharge amount, based on the desired selection signal. As such, it can easily switch the counter every unit in accordance with the enable signal.

It is preferable in the discharge amount calculating device that the calculating sections are less than $2^n$ and are provided in a quantity matching the number resulting from the multiplication of the number of the fluids and the number of the multiple stages. As such, the counters are installed in a quantity matching the necessary number, in order to prevent the configuration of the counter section from becoming complicated.

Another aspect of the invention is to provide a fluid ejecting apparatus comprising: an ejecting mechanism that ejects at least one fluid at a discharge amount of multiple stages; and any one of the above-described discharge amount calculating devices for inputting discharge amount data of the fluid ejected from the ejecting mechanism. Since a fluid ejecting apparatus is highly needed to calculate the discharge amount of the ink, the application of the invention is meaningful.

BRIEF DESCRIPTION OF THE DRAWINGS

The invention will be described with reference to the accompanying drawings, wherein like numbers reference like elements.

FIG. 3 is a corresponding table of output sources from a conversion decoder.

FIG. 4 is a view explaining one example of conversion at 2 colors and a color depth of 4 stages.

FIG. 5 is a view explaining one example of conversion at 1 color and a color depth of 8 stages.

DESCRIPTION OF EXEMPLARY EMBODIMENTS

An exemplary embodiment to carry out the invention will now be described with reference to the accompanying drawings.

Figure 1:
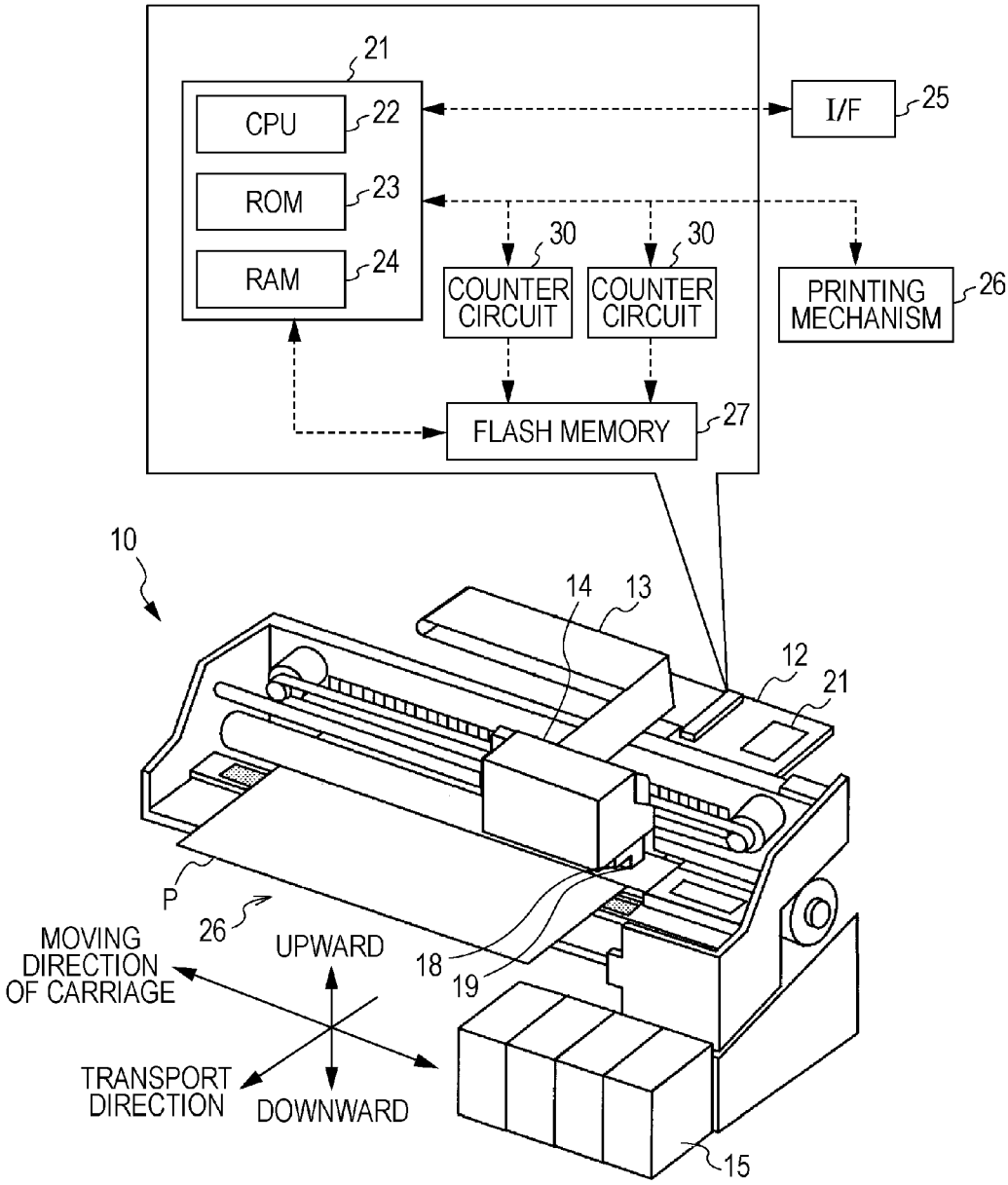
FIG. 1 is a view schematically illustrating the configuration of a printer according to an embodiment of the invention.
Figure 2:
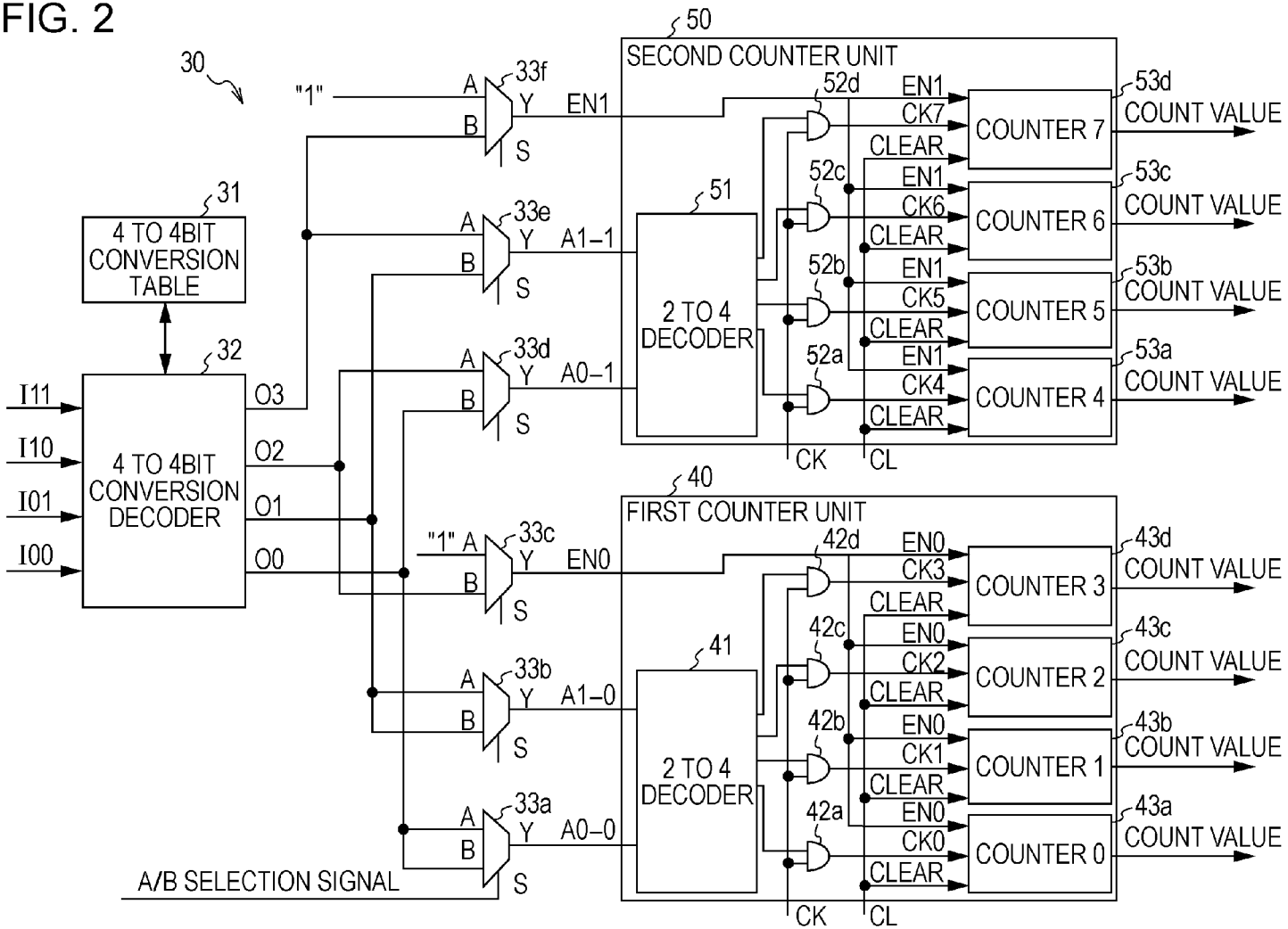
FIG. 2 is a block diagram schematically illustrating the configuration of a counter circuit according to an embodiment of the invention.

FIG. 1 is a view schematically illustrating the configuration of a printer 10 according to an embodiment of the invention. FIG. 2 is a block diagram schematically illustrating the configuration of a counter circuit 30 according to an embodiment of the invention. The printer 10 according to this embodiment includes, as shown in FIG. 1, an interface (I/F) 25 for inputting and outputting information between the printer 10 and an external appliance which is connected to the printer 10, and an ink jet-type printing mechanism 26 for ejecting a fluid, i.e., ink, onto a target, i.e., a printing paper P, to perform a print function, based on print data. Also, the printer 10 includes a main board 12, for example, on which a controller 21 for controlling the whole apparatus is mounted, and a carriage 14 connected to the controller 21 via a wiring 13 and moved in a desired moving direction. The carriage 14 is provided under the bottom thereof with a print head 18 for ejecting the ink which is pressured by a piezoelectric device from a nozzle 19. The print head 18 is adapted to eject ink droplets at color depth of 4 stages, i.e., the print head 18 can eject 4 kinds of ink sizes, that is, micro-small sized, small sized, medium sized and large sized ink droplets, respectively. The printer 10 further includes an ink cartridge 15 for supplying the ink to the carriage 14 via a tube (not shown) installed in a case. The ink cartridge 15 includes separate tanks each filled with ink of four colors, for example, cyan (C), magenta (M), yellow (Y), and black (K). Meanwhile, it is preferable that the print head 18 employs a configuration for pressing the ink by the use of a heater to eject the ink onto a printing paper P.

In addition to the controller 21, the main board 12 is provided with a counter circuit 30 for calculating the amount of ink of the respective colors ejected towards the printing mechanism 26, and a flash memory 27 that stores with, for example, the remaining amount of the ink which is filled in the ink cartridge 15 and is calculated from the amount of the ink calculated by the counter circuit 30. The controller 21 consists of a microprocessor centering on a CPU 22. The controller 21 includes a ROM 23 stored with diverse kinds of process programs, and a RAM 24 temporarily stored with data. The printer 10 requires 16 counters, the number of counters being calculated by multiplying the number of ink, i.e., 4, ejected towards the print head 18 by the number of stages of color depth, i.e., 4. The counter circuit 30 is adapted to process a 4-bit signal (n=4), and consists of 8 counters 43*a* to 43*d* and 53*a* to 53*d*. Accordingly, the printer 10 includes two counter circuits 30 in order to count up to 16 ($2^n$; n=4). For descriptive convenience, one of the counter circuits 30 will now be described in detail.

The counter circuit 30 includes a conversion table 31, which is determined so that input signals and output signals correspond to each other, a conversion decoder 32 for converting the signals by using the conversion table 31, selectors 33*a* to 33*f* for performing the switching of input sources in accordance with a selection signal S, a first counter units 40 having four counters which calculate an amount of ink, and a second counter unit 50 having the same configuration as that of the first counter unit 40. The counter circuit 30 includes two units having four counters. For descriptive convenience, the selectors 33*a* to 33*f* are hereinafter collectively referred to as a selector 33, gates 42*a* to 42*d* are hereinafter collectively referred to as a gate 42, counters 43*a* to 43*d* are hereinafter collectively referred to as a counter 43, gates 52*a* to 52*d* are hereinafter collectively referred to as a gate 52, and counters 53*a* to 53*d* are hereinafter collectively referred to as a counter 53.

The first counter unit 40 consists of a unit decoder 41 for converting an input 2-bit signal into a 4-bit signal for output, gates 42*a* to 42*d* connected to the unit decoder 41, and a plurality of counters 43*a* to 43*d* for performing the calculating in accordance with the input signal. The unit decoder 41 includes an input connected to two lines A0-0 and A1-0 which input a count signal, and an output connected to four signal lines. The four signal lines are respectively connected to one of inputs of the gates 42*a* to 42*d*. The unit decoder 41 outputs '1' to the gate 42*a*, if '00' is inputted to the lines A1-0 and A0-0. The unit decoder 41 outputs '1' to the gate 42*b*, if '01' is inputted to the lines A1-0 and A0-0. The unit decoder 41 outputs '1' to the gate 42*c*, if '10' is inputted to the lines A1-0 and A0-0. The unit decoder 41 outputs '1' to the gate 42*d*, if '11' is inputted to the lines A1-0 and A0-0. The other inputs of the gates 42*a* to 42*d* are respectively connected to signal lines of clock signals from the CPU 22. The gate 42 is an AND gate which outputs a signal of '1', if two input signals are '1'. For example, the gate 42*a* outputs '1' as an output signal, if the signals from the unit decoder 41 and the clock signal are '1'. The line CK0 connected to the output of the gate 42*a* is connected to the input of the counter 43*a*, the line CK1 connected to the output of the gate 42*b* is connected to the input of the counter 43*b*, the line CK2 connected to the output of the gate 42*c* is connected to the input of the counter 43*c*, and the line CK3 connected to the output of the gate 42*d* is connected to the input of the counter 43*d*. In addition to the line inputted with the output signal from the gate, the counter 43 is connected at the inputs thereof to a line EN0 for transmitting an enable signal to enable the calculating of the counter count, and a line CL for transmitting a clear signal to clear the CPU 22 of a count value. The counter 43 is allowed to perform the calculating, if the enable signal '1' is inputted. Also, the counter 43 increments the counter value by '1', if the output signal '1' is inputted. The counter 43 is connected at the outputs thereof to the signal line for outputting the count value. In the counter 43, the counter 43*a* is set to count color depth '0', the counter 43*b* is set to count color depth '1', the counter 43*c* is set to count color depth 2, and the counter 43*d* is set to count color depth 3.

The second counter unit 50 consists of a unit decoder 51, gates 52*a* to 52*d* connected to the unit decoder 51, and counters 53*a* to 53*d* for performing the calculating in accordance with the input signal. The second counter unit 50 includes the same configuration as that of the first counter unit 40, except that lines for inputting the count signal are lines A0-1 and A1-1, and a line for transmitting the enable signal is a line EN1. In the counter 53, meanwhile, the counter 53*a* is set to count color depth '0', the counter 53*b* is set to count color depth '1', the counter 53*c* is set to count color depth '2', and the counter 53*d* is set to count color depth '3'.

The conversion decoder 32 consists of a circuit for converting the input 4-bit data into 4-bit data corresponding to the first counter unit 40 or the second counter unit 50 by the use of the conversion table 31. The conversion decoder 32 is connected at the input thereof to four lines I00, I01, I10 and I11, one end of the four lines being connected to the controller 21. Also, the conversion decoder 32 is connected at the output thereof to one end of four lines O0, O1, O2 and O3. The selectors 33*a* to 33*f* are connected to the other ends of the four lines O0, O1, O2 and O3. The selector 33 is connected to two inputs A and B, an input of the selection signal S, and an output Y. The selector 33 outputs a signal inputted from the input A through Y, when the selection signal S for modes A and B is a signal A (e.g., '1'). The selector 33 outputs a signal inputted from the input B through Y, when the selection signal S is a signal B (e.g., '0'). More specifically, the selector 33 is a circuit for performing switching between the signals.

The other end of the line O0 which is connected between the conversion decoder 32 and the selector 33 is connected to the inputs A and B of the selector 33*a* and the input B of the selector 33*d*. The other end of the line O1 is connected to the inputs A and B of the selector 33*b* and the input B of the selector 33*e*. The other end of the line O2 is connected to the input B of the selector 33*c* and the input A of the selector 33*d*. And, the other end of the line O3 is connected to the input A of the selector 33*e* and the input B of the selector 33*f*. Also, the inputs A of the selectors 33*c* and 33*f* are always inputted with a signal '1'. The output Y of the selector 33*a* is connected to the line A0-0 for transmitting the signal to the unit decoder 41, and the output Y of the selector 33*b* is connected to the line A1-0 for transmitting the signal to the unit decoder 41. The selector 33*c* is connected at the output Y thereof to the line EN0 for transmitting the enable signal to the counter 43, so that it is an output source of the enable signal to the first counter unit 51. The output Y of the selector 33*d* is connected to the line A0-1 for transmitting the signal to the unit decoder 51, and the output Y of the selector 33*e* is connected to the line A1-1 for transmitting the signal to the unit decoder 51. The selector 33*f* is connected at the output Y thereof to the line EN1 for transmitting the enable signal to the counter 53, so that it becomes an output source of the enable signal to the second counter unit 50. FIG. 3 is a corresponding table of the output sources from the conversion decoder 32.

The counter circuit 30 is adapted to perform switching between the mode A to simultaneously calculate the discharge amount of the ink by the use of the first counter unit 40 and the second counter unit 50 and the mode B to calculate the discharge amount of the ink by the use of either the first counter unit 40 or the second counter unit 50, by respectively switching the enable signal which is inputted to the first counter unit 40, and the enable signal which is inputted to the second counter unit 50, by the selector 33*c* or the selector 33*f* in accordance with the selection signal S. Also, the counter circuit 30 is adapted to respectively switch the signal which is inputted to the first counter unit 40, and the signal to be inputted to the second counter unit 50 by the selector 33 in accordance with the selection signal S, and perform switching between the mode A to calculate the discharge amount of the ink, in the case that the number of the colors is 2 and the stage of the color depth is 4, and the mode B to calculate the discharge amount of the ink, in the case that the number of the color is 1 smaller than that of mode A and the stage of the color depth is 8 higher than that of the mode A. That is, two counter units simultaneously calculate the discharge amount of the ink at two colors and a color depth of 4 stages in the mode A, while either of the two counter units calculates the discharge amount of the ink at one color and a color depth of 8 stages in mode B. The printer 10 always outputs the selection signal S to select the mode A from the controller 21.

An example of the conversion of the conversion table 31 will now be described. FIG. 4 is a view explaining one example of conversion using the conversion table 31 at 2 colors and a color depth of 4 stages. FIG. 4 shows input values on the lines I00 to I11 at its middle portion and output values on the lines O0 to O3 at its lower portion. The conversion table 31 is determined on the basis of the downstream configuration of the conversion decoder 32, for example, installation of the selector 33, the number of the counters, and the operation mode A or B of the respective counters. The conversion table 31 is set in such a way to output the input value intact, without converting the input value, as follows: if the color depth of 4 stages (i.e., stages 0 to 3) is inputted for one color and the stages are respectively set to 2-bit input 00, 01, 10 and 11, the lines I00 and I01 correspond to one of two colors, while the lines I10 and I11 correspond to the other of the two colors; and the line I00 outputs the input value to the line O0 intact, the line I01 outputs the input value to the line O1 intact, the line I10 outputs the input value to the line O2 intact, and the line I11 outputs the input value to the line O3 intact. As such, each of the counters 43*a* to 43*d* can calculate the amount of ink at one color and the color depth of 1 stage, and the counters 53*a* to 53*d* can calculate the amount of the ink at one color and a color depth of 1 stage.

Then, the operation of the counter circuit 30 with the configuration described above according to this embodiment will now be described. If the controller 21 is inputted with the print data from the I/F 25, the controller 21 controls the drive of the printing mechanism 26 based on the print data to allow the print head 18 to eject the ink of each color onto the printing paper P in a quantity matching the color depth of each stage. In this instance, the counter circuit 30 is inputted with the signal to drive the print head 18 via the lines I00 to I11, as well as a clock signal. The input 4-bit signal is converted into data corresponding to the counter by means of the conversion decoder 32 on the basis of the conversion table 31, and then the data is outputted to the selector 33 as a 4-bit signal via the lines O0 to O3. The selector 33 is operated in mode A, in which two counter units can simultaneously perform the calculating, and the counter circuit 30 calculates the amount of ink for the ink of two colors at a color depth of 4 stages. If the enable signal is '1' and the signal outputted from the selector 33 is '1', each counter ejects the ink of the corresponding color at the corresponding color depth, so that the counter value is incremented by '1'. The counter value of the respective counters is outputted at a desired timing, and then the outputted counter value is added to obtain the discharge amount of the ink. The discharge amount is subtracted from remaining amount of the ink, and then the result is stored in the flash memory 27 as the current remaining amount of the ink. In this instance, the controller 21 outputs a clear signal, and the counters 43 and 53 receive the clear signal to clear the clear values, respectively.

Now, a printer having ink of 4 colors capable of ejecting the ink at color depth of 8 stages, which is different from the printer 10, will be described hereinafter. FIG. 5 is a view explaining one example of conversion using the conversion table 31 at 1 color and a color depth of 8 stages. FIG. 5 shows input values on the lines I00 to I11 at its middle portion and output values on the lines O0 to O3 at its lower portion. The configuration includes four counter circuits 30 every color, and the selection signal S to always select mode B is outputted from the controller 21. In this instance, it is preferable that the conversion table 31 is set in such a way to convert and output the input value, as follows: the color depth of 8 stages (i.e., stages 0 to 7) is inputted for one color; if the stages are respectively set to 3-bit inputs 000, 001, . . . , 110 and 111, the line I11 is not used, and the lines I00, I01 and I10 correspond to one color; the line I00 outputs the input value to the line O0, and the line I01 outputs the input value to the line O1; if the enable signal is '1', the line I10 outputs the input to the line O3, while if the enable signal is '0', the line I10 outputs the input '1' to line O2; and the line I11 is disregarded. As such, each of the counters 43*a* to 43*d* and 53*a* to 53*d* can calculate the amount of the ink at one color and a color depth of 1 stage, respectively.

If increased color depth (e.g., a dot size) or the like is considered, for example, and it makes an attempt to calculate the total amount of the ink comprising 1 bit/color, 2 bit/color, and 3 bit/color, it is necessary to detect the number of bits and kind of the signal, and 1+4+8 kinds of counters should be prepared. In addition, if 4-bit color depth is set to 8 stages, 16 counters should be prepared. The counter circuit 30 employs the conversion table 31, and can convert the input signal into any 4-bit signal, even if the input signal is 1 bit/color, 2 bit/color, 3 bit/color, and the like. Also, the counter circuit 30 can adapt the signal outputted from the conversion decoder 32 to each counter. The counter circuit 30 includes 2 units each having 4 counters, and can change the conversion mode by the use of the conversion table 31. In addition, the counter can suppress the increased number of the counters by changing the count mode of the selector 33. As a result, the counter circuit can be applied to any print head of various configurations.

The corresponding relation between components of the embodiment and components of the invention will be apparent from the following description. The printer 10 of the embodiment corresponds to a fluid ejecting apparatus of the invention, the print head 18 corresponds to an ejecting mechanism, the counter 43 and the counter 53 correspond to a plurality of calculating sections, the conversion table 31 and the conversion decoder 32 correspond to a converting section, the selector 33 corresponds to a calculate switching section and a unit switching section, the selector 33*c* and the selector 33*f* correspond to an enable switching portion, and the first counter unit 40 and the second counter unit 50 correspond to a first calculating unit and a second calculating unit. The printer 10 of the embodiment corresponds to a fluid ejecting apparatus of the invention, and the print head 18 corresponds to an ejecting mechanism. In addition, the ink corresponds to a fluid, the printing paper P corresponds to a target, the mode A corresponds to a first mode and a synchronous mode, and the mode B corresponds to a second mode and a selection mode.

According to the printer 10 of the embodiment as described above, the inputted discharge amount data of n bits (n=4) is converted into n-bit data corresponding to any one of the plurality of counters (n=4) by means of the conversion decoder 32, and then the converted data is outputted to the counter. The discharge amount of the ink ejected at each color depth of multiple stages is calculated by means of the counters, in which the desired number of counters does not exceed $2^n$, based on a bit number of the input data. Even when the data is converted by the conversion decoder 32 corresponding to the counter, for example, the number of stages of the color depth or the kind/number of the ink is changed, the apparatus according to the invention can easily cope with the change by altering the conversion method of the conversion decoder 32. Accordingly, the invention can more properly cope with various configurations having discharge amounts of multiple stages and several numbers of ink. Also, since the mode A to calculate the discharge amount of the ink of 2 colors at the color depth of 4 stages and the mode B to calculate the discharge amount of the ink of 1 color which is less than that of the mode A at the color depth of 8 stages which is greater than that of the mode A can be switched in accordance with the selection signal S, the invention can more properly cope with various configurations by switching the mode, of which any one of the number of stages of the discharge amount and the number of the ink is selected as a main. Since the mode A to simultaneously calculate the discharge amount of the ink by the use of the first counter unit 40 and the second counter unit 50 and the mode B to calculate the discharge amount of the ink by the use of either the first counter unit 40 or the second counter unit 50 can be switched in accordance with the selection signal S, the invention can more properly cope with various configurations by switching the counter every unit. In addition, the selectors 33*c* and 33*f* can more relatively easily switch the counter for each unit in order to output the data inputted by the conversion decoder 32 as an enable signal which can calculate the discharge amount. Since the counters are installed in quantity matching the number obtained by multiplying the number, '4', of the colors by the stage numbers, '4', of the color depth, the counters are installed in quantity matching the necessary number, so that the invention can prevent the configuration of the counter from becoming complicated. Also, the application of the invention is meaningful since it is necessary for the printer 10 to calculate the discharge amount of the ink.

The invention is not limited to the above-described embodiment at all, and can be implemented as various aspects without departing from the scope of the following claims.

Figure 6:
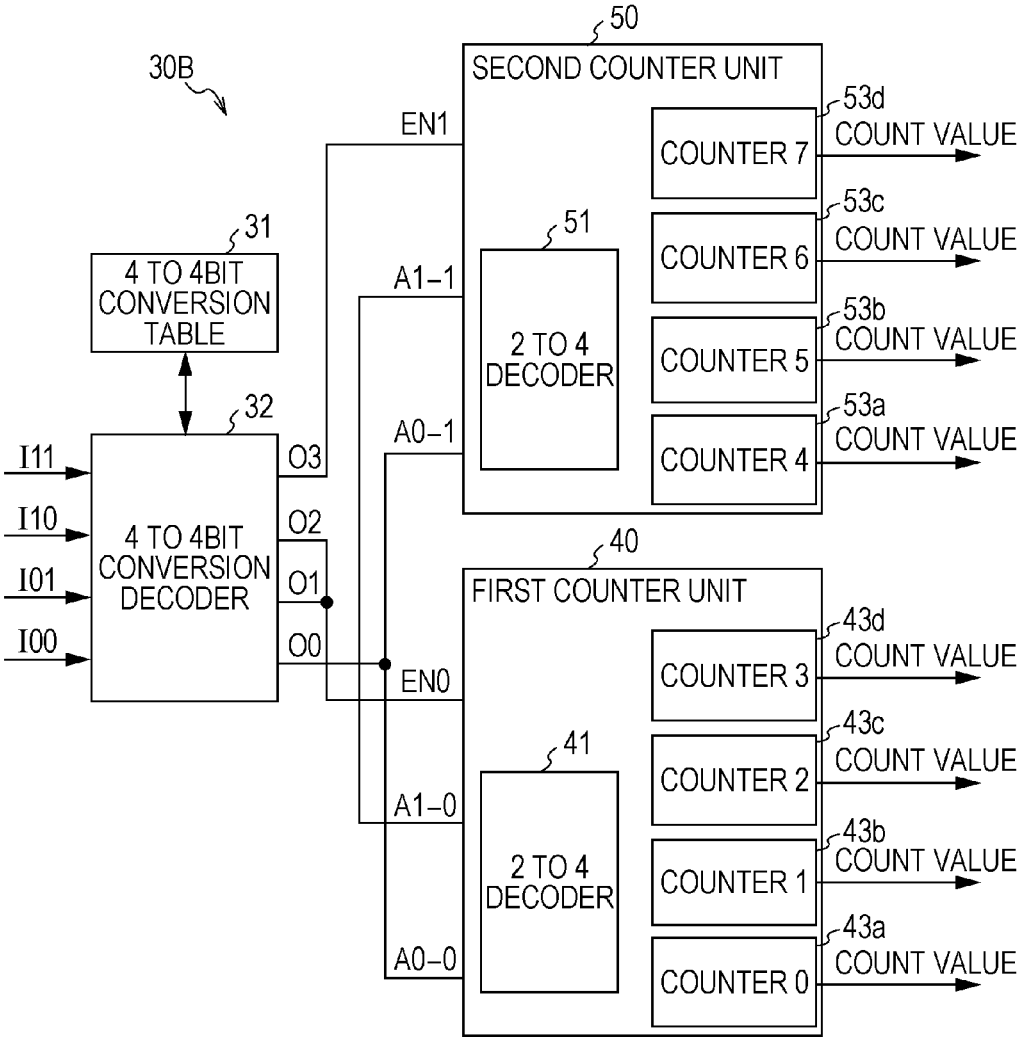
FIG. 6 is an illustrative view of a counter circuit according to another embodiment of the invention.

For example, although the selector 33 performs switching between the mode A and the mode B in the above-described embodiment, the selector 33 may be omitted, as shown in FIG. 6, and the switching of the modes A and B may be omitted. FIG. 6 is a view explaining a counter circuit 30B according to another embodiment of the invention. In the counter circuit 30B, the selector 33 of the counter circuit 30 is omitted and the counter circuit 30B performs the connection of the mode B described in the counter circuit 30. It cannot perform the switching of the modes A and B, but the counter circuit 30B can more properly cope with various configurations by the conversion carried out by the conversion table 31. Meanwhile, although FIG. 6 shows the counter circuit 30B which performs the connection of the mode B described in the counter circuit 30, the counter circuit 30B may perform the connection of the mode A described in the counter circuit 30, or may perform any connection in accordance with the number of colors and the stage number of the color depth.

Although switching is performed between the mode A to simultaneously calculate the discharge amount of the ink by the use of the first counter unit 40 and the second counter unit 50 and the mode B to calculate the discharge amount of the ink by the use of either the first counter unit 40 or the second counter unit 50 in the above-described embodiment, this switching may be omitted. Although the plurality of counters is divided into the plurality of counter units in the above-described embodiment, the counter units do not have to be employed. In the above-described embodiment, switching is performed between the mode A to simultaneously calculate the discharge amount of the ink of 2 colors at the color depth of 4 stages by the use of two counter units and the mode B to calculate the discharge amount of the ink of 1 color at the color depth of 8 stages by the use of either of two counter units. However, switching between a mode A to calculate the discharge amount of ink of 2 colors at color depth of 4 stages and a mode B to calculate the discharge amount of ink of 1 color at color depth of 8 stages, or switching between a mode A to simultaneously calculate a discharge amount by the use of two counter units and a mode B to calculate a discharge amount by the use of either of two counter units may be performed.

In the above-described embodiment, although the input data is 4 bits, it is not limited to data under the condition that the output number exceeds by an input number. That is, the data may be 3 bits or 8 bits. Also, although the conversion decoder 32 converts 4 bits into 4 bits, it is not limited thereto.

In the above-described embodiment, although it is described that the mode A is a mode to calculate the discharge amount of the ink of 2 colors at the color depth of 4 stages and the mode B is a mode to calculate the discharge amount of the ink of 1 color at the color depth of 8 stages, any configuration is allowed which performs switching between a first mode to calculate the discharge amount of ink of first color at the first color depth and a second mode to calculate the discharge amount of ink of second color less than that in the first mode at a second color depth greater than that in the first mode. Also, although the number of the switching modes is 2, 3 or more switching modes are allowed.

In the above-described embodiment, although the printer 10 is exemplified as the fluid ejecting apparatus, aspects of the invention may be embodied as a printing apparatus that ejects or discharges a liquid other than ink, including a liquid body in which particles of functional material are dispersed (fluid dispersion), and a flowage body such as gel, or that ejects or discharges a solid which can be ejected as ink. For example, the fluid ejecting apparatus may be a liquid ejecting apparatus that ejects a liquid in which a material such as an electrode material or a color material, which is used for manufacturing a liquid crystal display, an EL (electroluminescence) display, a surface emitting display or a color filter, is dissolved, a liquid body ejecting apparatus that ejects a liquid body in which the same materials are dispersed, or a fluid ejecting apparatus that is used as a precision pipette to discharge a sample of liquid. Furthermore, the fluid ejecting apparatus may be a liquid ejecting apparatus that ejects a transparent resin liquid, such as an ultraviolet curing resin, for forming a microscopic semi-spherical lens (optical lens) used for an optical communication element, or the like, on a substrate, a flowage ejecting apparatus that ejects a gel or a powder ejecting-type recording apparatus that ejects powder such as toner.

What is claimed is:

1. A device for calculating a discharge amount of at least one fluid from a fluid ejecting apparatus, the fluid ejecting apparatus being capable of ejecting the at least one fluid onto a target at a plurality of droplet sizes, the device comprising:

a plurality of calculating sections that calculate the discharge amount of the fluid by counting the droplets of each droplet size, based on a bit number of input data, the calculating sections not exceeding $2^n$ in number, in which n is a positive integer;

wherein one counter is provided for each droplet size;

a converting section comprising a conversion table, wherein the converting section uses the conversion table to convert the input data of n bits into bit number data corresponding to any one of the plurality of calculating sections, and outputs the number data to the plurality of calculating sections; and a switching section that is connected between the calculating section and the converting section to perform switching between a first mode to calculate the discharge amount as a first number of the fluids and a first number of droplet sizes, and a second mode to calculate the discharge amount as a second number of fluids less than the first number of fluids and a second number of droplet sizes greater than the first number of droplet sizes, in accordance with a desired selection signal.

2. A fluid ejecting apparatus comprising:

an ejecting mechanism that ejects at least one fluid at a plurality of droplet sizes; and the device according to claim 1 for inputting discharge amount data of the fluid ejected from the ejecting mechanism.

* * * * *